United States Patent [19]

Behn

[11] 4,074,897

[45] Feb. 21, 1978

[54] REINFORCING BAR ALIGNER AND CLAMP

[75] Inventor: Frederick H. Behn, St. Petersburg, Fla.

[73] Assignee: Construction Innovations, Inc., Rolling Meadows, Ill.

[21] Appl. No.: 738,879

[22] Filed: Nov. 4, 1976

[51] Int. Cl.[2] ..... B25B 1/20

[52] U.S. Cl. ..... 269/43; 269/128; 269/282; 269/321 N

[58] Field of Search ..... 269/321 N, 43, 126–128, 269/282

[56] References Cited

U.S. PATENT DOCUMENTS

| | | | |
|---|---|---|---|
| 296,333 | 4/1884 | Jarecki | 269/128 |
| 1,740,863 | 12/1929 | Krause | 269/126 |
| 2,381,584 | 8/1945 | Fulleton | 269/43 |
| 2,638,676 | 5/1953 | Callahan | 269/43 |
| 2,932,995 | 4/1960 | Durfee | 269/321 N |

FOREIGN PATENT DOCUMENTS

| | | | |
|---|---|---|---|
| 376,757 | 7/1932 | United Kingdom | 269/43 |

*Primary Examiner*—Robert C. Watson
*Attorney, Agent, or Firm*—Anthony S. Zummer

[57] ABSTRACT

A reinforcing bar aligner and clamp is herein disclosed. The reinforcing bar aligner and clamp has a square cross-section tubular support arm. A pair of clamps is attached to the tubular arms. Each clamp of said pair is connected to the support arm adjacent an end of the support arm. Each of the clamps is a hinged clamp having an inner right angle jaw and an outer cover jaw. A latch selectively connects the outer cover jaw to the inner right angle jaw. The hinged clamps are adapted to hold a first reinforcing bar in fixed end-to-end proximity to a second reinforcing bar.

2 Claims, 12 Drawing Figures

REINFORCING BAR ALIGNER AND CLAMP

BACKGROUND OF THE INVENTION

Reinforcing bars, or rebars as they are called in the construction industry, are used in a wide variety of applications. The reinforcing bar is a piece of cylindrical steel, having a maximum diameter of 2½ inches and having an uneven exterior surface. Reinforcing bars come in a variety of standard lengths. Among the longest are 40 foot bars. It may be appreciated that, if a longer bar is desired to be used, it is necessary to join, end-to-end, two or more reinforcing bars in some fashion.

It is well-known in the industry to splice a first and second reinforcing bars end-to-end by means of a rebar splicing collar into which molten metal is poured. The rebar splicing collar is tubular in configuration, and accepts a pair of ends of the reinforcing bars to be joined. A quantity of molten filler metal is poured into the space between the reinforcing bars and the interior of the splicing section, and hardens therein, thus joining the bars and the splicing section together. In use, this type of splicing is convenient, but does present some difficulties. When splicing vertical bars together, particularly 2½ inch diameter or number 18 bars, it is necessary that a crane hold the upper reinforcing bar in place while the metal hardens within the collar. This process typically takes half an hour. Currently, cost of construction crane time is typically about $200.00 per hour. Thus, it may be appreciated that a cost of $100.00 per splice merely for the use of crane time is a very expensive reinforcing bar splice.

What is needed, then, is a holder which can hold a pair of heavy reinforcing bar sections in spaced proximity to allow their joinder by a reinforcing bar splicing device, as above mentioned. Clamps of the holder should have a variable jaw size to enable various diameters of reinforcing bars to be used. In addition, the variable jaw size is necessary in order that two reinforcing bars having different diameters may be spliced together.

SUMMARY OF THE INVENTION

A reinforcing bar aligner and clamp is disclosed herein. The reinforcing bar aligner and clamp has a support column, which has a square cross-section. The support column has a hollow interior, and has connected thereto two pairs of mounting plates. Each pair of mounting plates holds a hinged clamp. Each hinged clamp includes an inner V-jaw. The inner V-jaws are adapted to engage a reinforcing bar. A rotatable cover plate is hingedly connected to each V-jaw. The rotatable cover assembly is selectively rotatable into proximity with each of the inner V-jaws.

The reinforcing bar aligner and clamp is employed by securing one hinged clamp around a first reinforcing bar. It is only necessary that a crane be used to lift an upper reinforcing bar into proximity with the lower reinforcing bar and a splicing collar, where it is clamped in spaced proximity to the lower reinforcing bar by the reinforcing bar aligner and clamp. The crane can then move on to perform other tasks while permanent joinder between the upper and lower reinforcing bars is being effected with a rebar splicing kit.

It is a principal object of the present invention to provide a reinforcing bar aligner and clamp which can hold a pair of reinforcing bars in a proximately spaced collinear relationship, from which they easily can be spliced together.

It is another object of the instant invention to provide a reinforcing bar aligner and clamp having adjustable size clamps in order to accommodate varying size reinforcing bars.

It is a still further object of the instant invention to provide a reinforcing bar aligner and clamp having a relatively light-weight and small structure to enable the reinforcing bar aligner and clamp to be easily moved manually from place to place.

Other objects and uses of the instant invention will become readily obvious to one skilled in the art upon a perusal of the following specification and claims in light of the accompanying drawings.

DESCRIPTION OF THE PREFERRED EMBODIMENT

Figure 1:
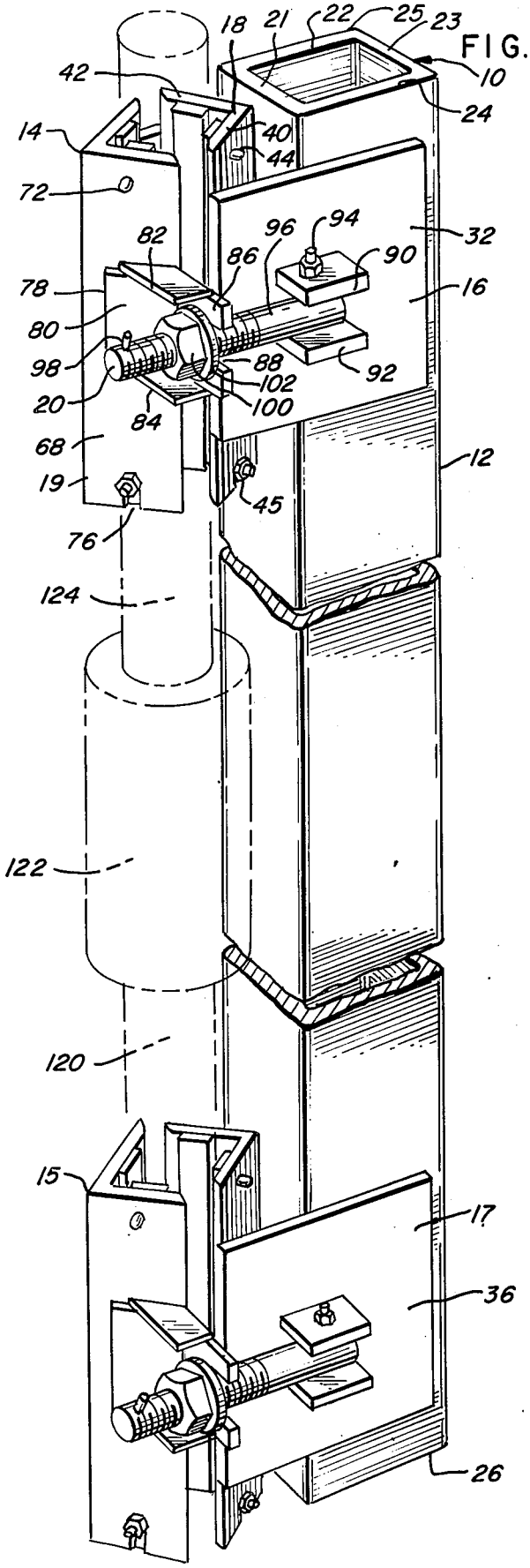
FIG. 1 is a perspective view of a reinforcing bar aligner and clamp, embodying the instant invention, having sections broken away and showing a dotted pair of reinforcing bars in spaced proximity with each other and with a splicing tube.
Figure 7:
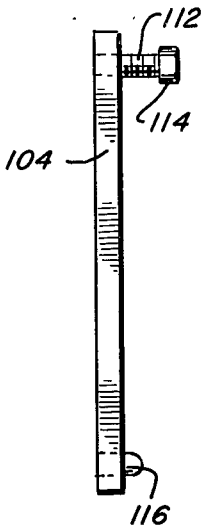
FIG. 7 is a side view of a shim for the clamp.
Figure 8:
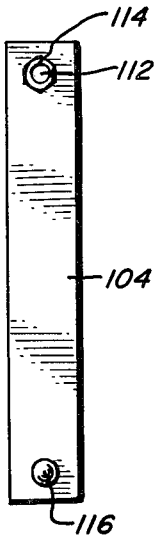
FIG. 8 is a front view of a shim for the clamp.
Figure 2:
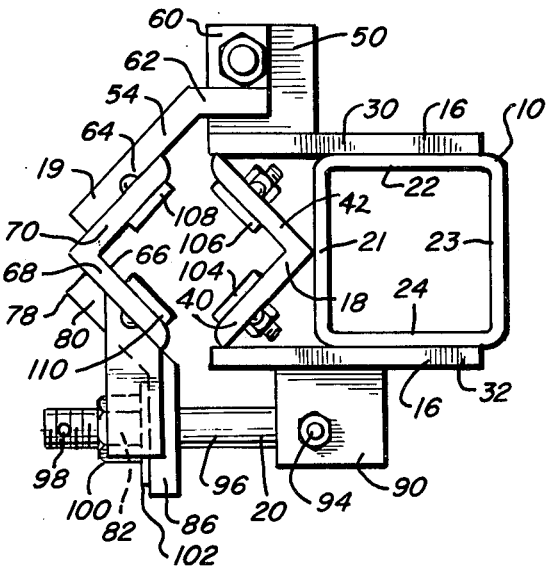
FIG. 2 is a top view of the reinforcing bar aligner and clamp of FIG. 1, showing details of a clamp in a closed position.
Figure 4:
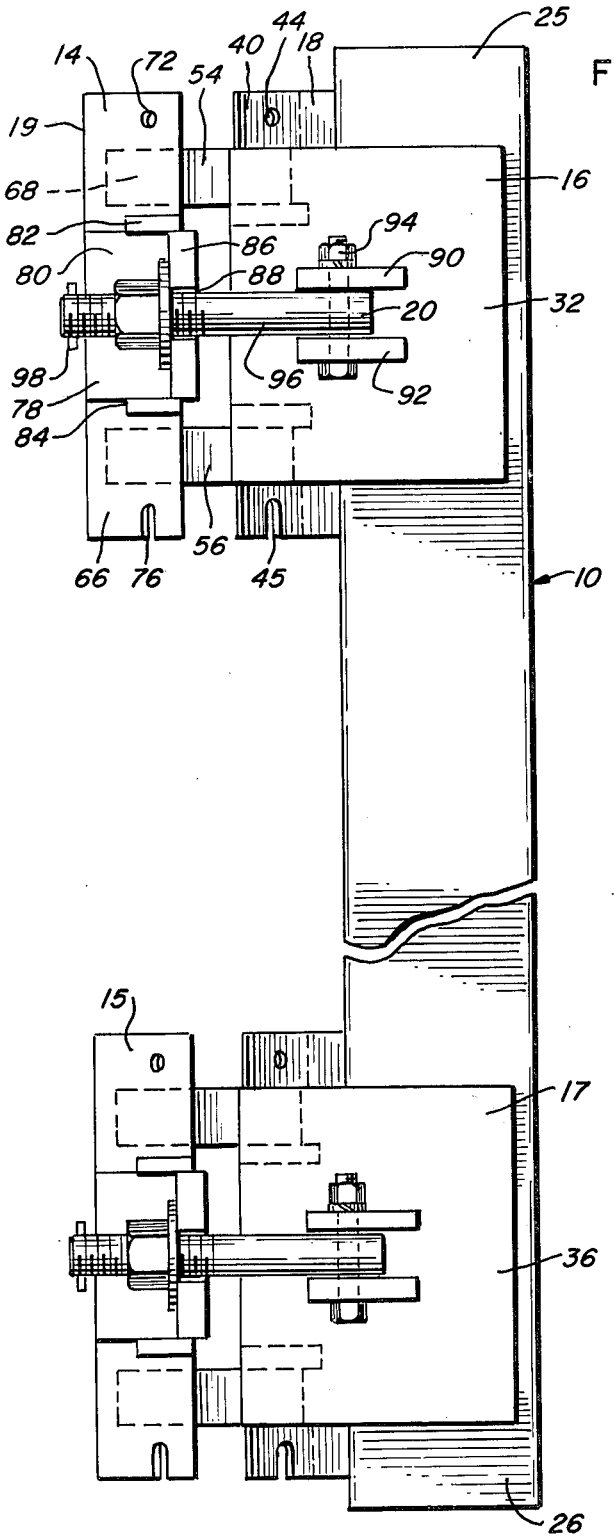
FIG. 4 is a right side view of the reinforcing bar aligner and clamp of FIG. 1, having a portion broke away and showing the details of the threaded latch mechanism of each of the clamps.
Figure 3:
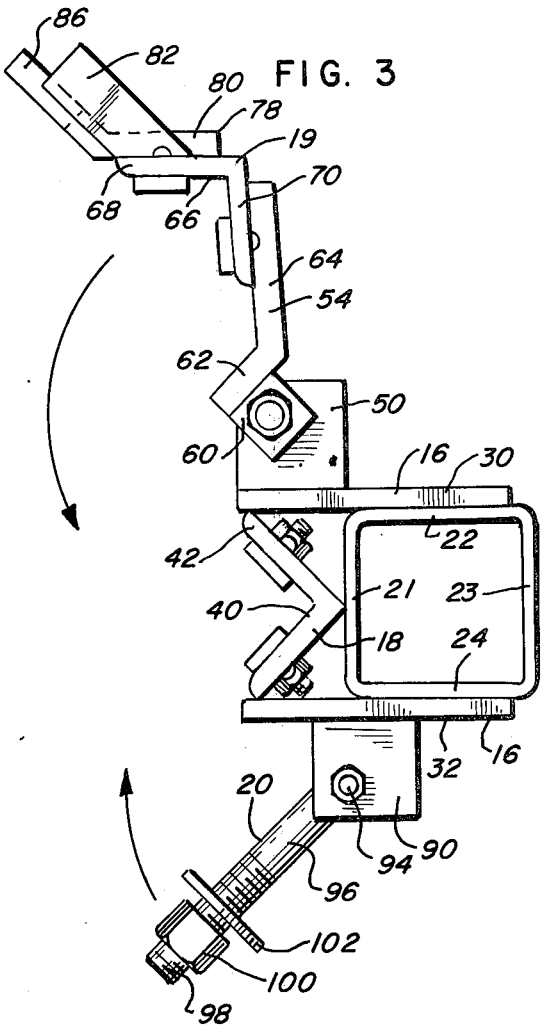
FIG. 3 is a top view of the reinforcing bar aligner and clamp of FIG. 2, in an open position.
Figure 5:
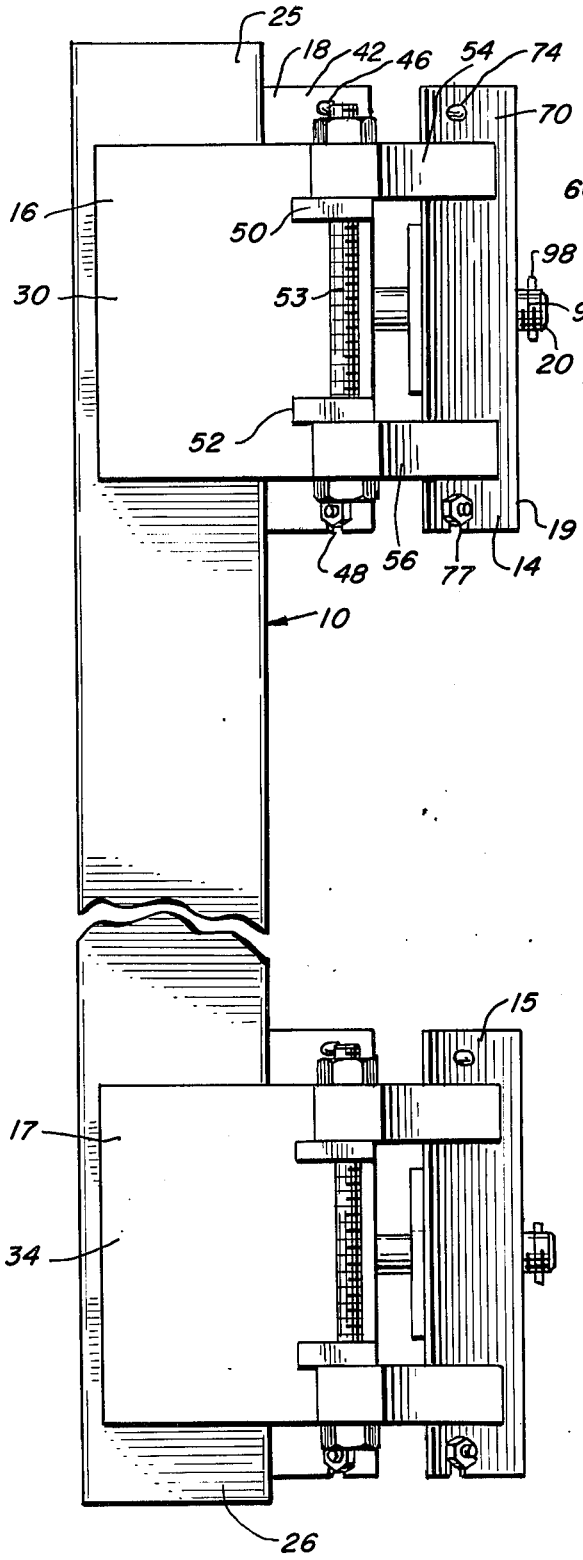
FIG. 5 is a left side view of the reinforcing bar aligner and clamp of FIG. 1.
Figure 6:
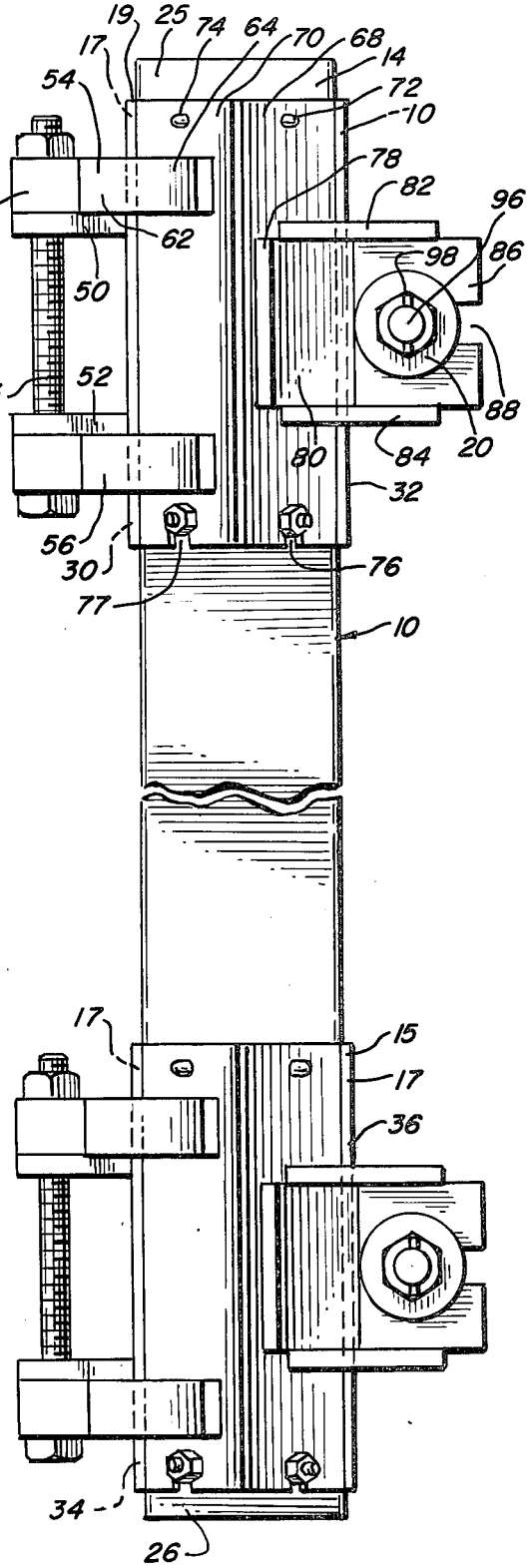
FIG. 6 is a front view of the reinforcing bar aligner and clamp of FIG. 1.
Figure 9:
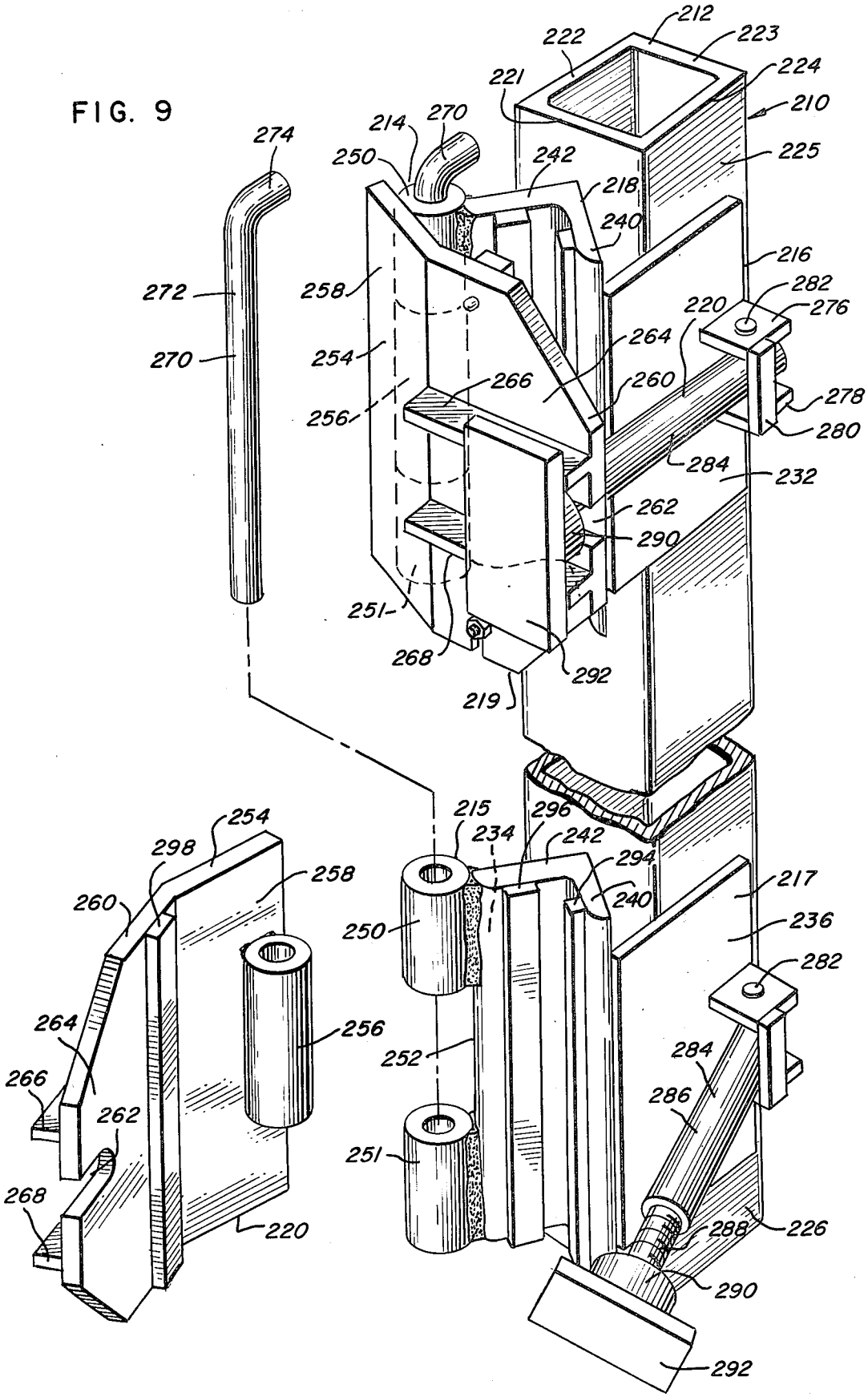
FIG. 9 is a perspective exploded view of another embodiment of a reinforcing bar aligner and clamp.
Figure 10:
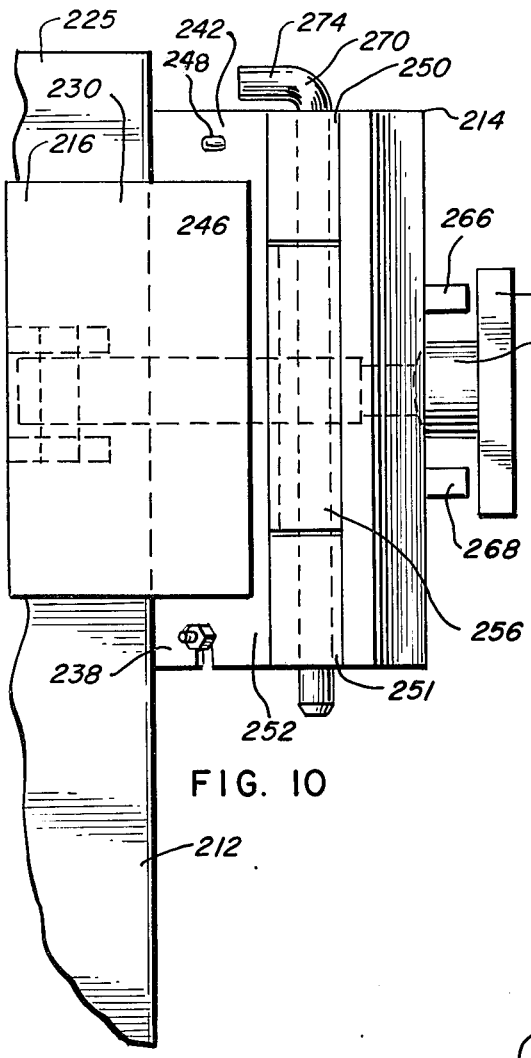
FIG. 10 is a right side view of the reinforcing bar aligner and clamp shown in FIG. 9.
Figure 11:
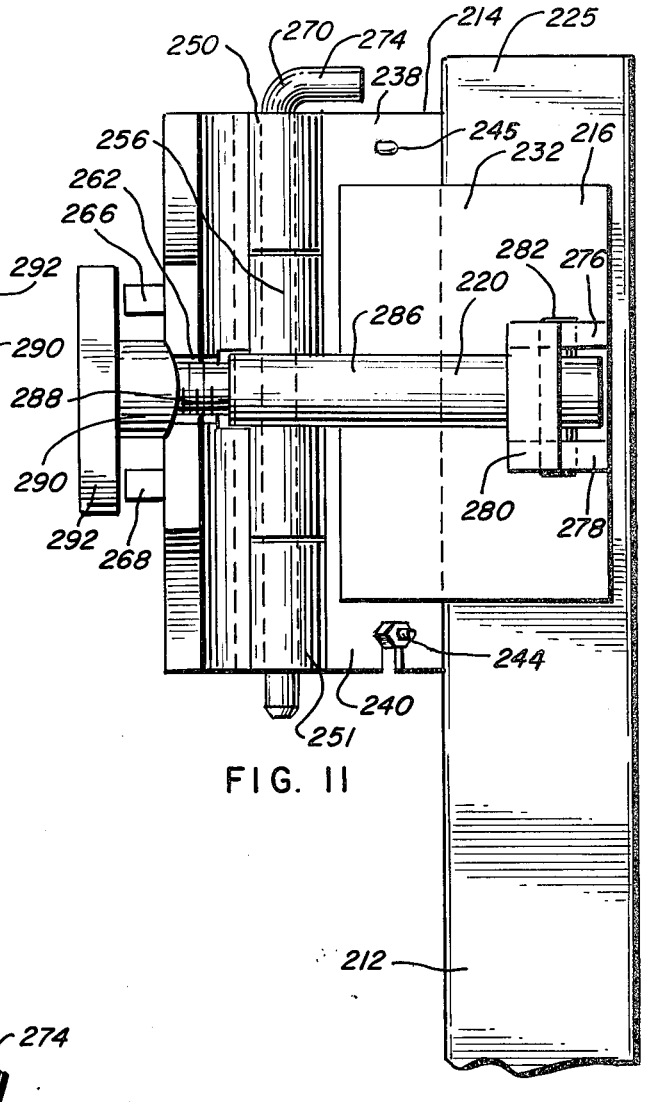
FIG. 11 is a left side view of the reinforcing bar aligner and clamp shown in FIG. 9.
Figure 12:
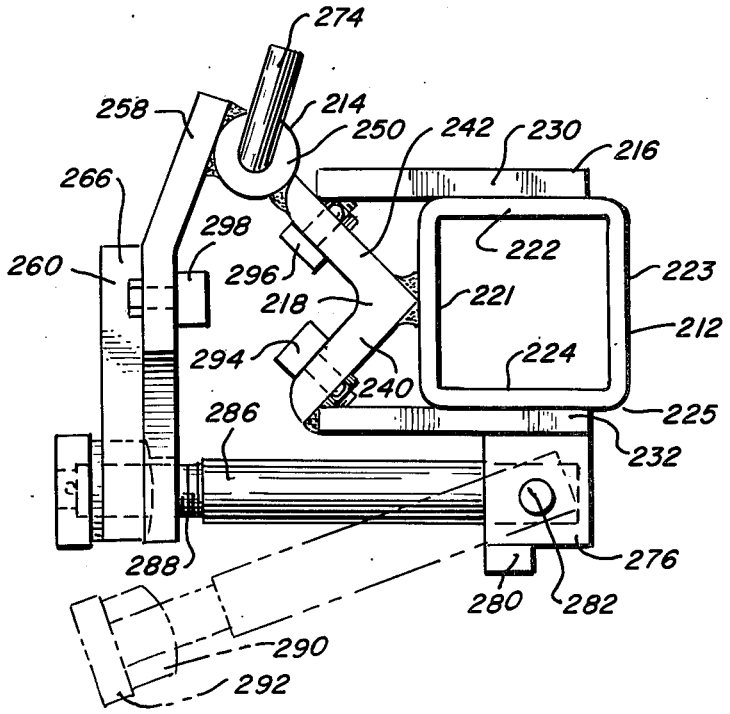
FIG. 12 is a top view of the reinforcing bar aligner and clamp shown in FIG. 9.

Referring now to the drawings, and especially to FIGS. 1 and 2, a reinforcing bar aligner and clamp embodying the present invention and generally indicated by the number 10 is shown therein. Reinforcing bar aligner and clamp 10 includes a support arm 12, to which is affixed a pair of clamps, respectively numbered 14 and 15. Each of the clamps 14 and 15 is connected to support arm 12 by a respective pair of mounting plates 16 and 17. Each of the clamps includes an inner V-jaw 18, an outer rotatable cover jaw 19 and a latch 20.

Support arm 12 is an elongated hollow steel support tube, having a square cross-section. Support arm 12 has a plurality of rectangular walls, respectively numbered 21, 22, 23 and 24. Support arm 12 has a pair of opposite ends, respectively numbered 25 and 26. Support arm 12 is five and one-half feet in length, and has a width of three inches.

Clamps 14 and 15 are identical. Clamp 14 is an exemplary clamp. Clamp 14 is connected to support arm 12 adjacent end 25 by the pair of rectangular mounting plates 16. Clamp 15 is connected to support arm 12 adjacent end 26 by the pair of mounting plates 17. The pair of mounting plates 16 includes a hinge plate 30, fixedly connected to wall 22 of support arm 12. A second mounting plate 32 is also included in the pair of mounting plates 16. Mounting plate 32 is also included in the pair of mounting plates 16. Mounting plate 32 is a latch mounting plate, and is connected to wall 24 of support arm 12. Plates 30 and 32 are positioned parallel to one another; and both extend an equal distance beyond wall 21 of support arm 12. In a similar fashion, the pair of mounting plates 17 includes a hinge plate 34, connected to wall 22 of support arm 12, and a latch plate 36, connected to wall 24 of support arm 12.

Inner V-jaw 18 includes a first inner jaw wall 40 and a second inner jaw wall 42. Second inner jaw wall 42 is formed integral with, and perpendicular to, first inner jaw wall 40. Both jaw wall 40 and jaw wall 42 are positioned at a 45° angle with respect to wall 21 of support arm 12. Jaw wall 40 has a circular aperture 44 and a slot 45 formed therein, at opposite ends. Jaw wall 42 has a circular aperture 46 and a slot 48 formed therein, at opposite ends.

A pair of hinge blocks, respectively numbered 50 and 52, is connected perpendicular to mounting plate 30. A threaded pivot pin 53 is connected to hinge blocks 50 and 52. A pair of hinge arms 54 and 56 is rotatably connected to threaded pivot pin 53. Hinge arms 54 and 56 are identical. Hinge arm 54, the exemplary hinge arm, has a pivot pin plate 60, which is connected to pivot pin 58. A riser plate 62 is formed integral with, and perpendicular to, pivot pin plate 60. A jaw plate 64 is formed integral with, and at a 45° angle to, riser plate 62. Jaw plate 64 is connected to an outer V-jaw 66, which is a portion of outer rotatable cover jaw 20. In a similar fashion, hinge bar 56 is also connected to outer V-jaw 66.

Outer V-jaw 66 is identical to inner V-jaw 19. Outer V-jaw 66 includes a pair of jaw walls, respectively numbered 68 and 70. Jaw walls 68 and 70 each respectively include a circular aperture 72 and 74, and a slot 76 and 77.

Latch 20 includes a latch arm 78 connected to jaw wall 68 of outer jaw 66. Latch arm 78 includes a jaw arm 80, affixed to jaw wall 68. A pair of outboard support walls 82 and 84 is connected to jaw plate 68, and positioned perpendicular jaw plate 68. A latch tongue 86 is formed integral with, an at a 45° angle to, jaw arm 80. Latch tongue 86 has a slot 88 formed therein.

Mounting plate 32 has a pair of hinge blocks 90 and 92 connected thereto. Hinge blocks 90 and 92 are perforated, and receive a hinge pin 94. A threaded latch rod 96 is pivotedly connected to hinge pin 94. Threaded latch rod 96 has a stop pin 98 connected thereto, opposite hinge pin 94. A nut 100 is threadedly connected to rod 96. A washer 102 is slideably connected to threaded rod 96. Nut 100 and washer 102 are adapted to engage tonque 86 of latch arm 78. Clamps 14 and 15 extend about 5 inches away from support arm 12. Clamps 14 and 15 are separated by a center-to-center distance of 57 inches. Clamp 15 is identical in configuration to clamp 14.

A plurality of elongated shims, respectively numbered 104, 106, 108 and 110, is connected to jaw plates 40, 42, 68 and 70, respectively. Shims 104, 106, 108 and 110 are identical. Shim 104 is an exemplary shim. Shim 104 is an elongated rectangular shim. Shim 104 extends substantially the entire length of the jaw plate in which it is fixed. Shim 104 has a threaded connector rod 112. A nut 114 engages connector rod 112. Shim 104 also has a locator pin 116. Locator pin 116 is somewhat shorter than threaded rod 112. Threaded rod 112 passes through slot 45 of jaw wall 40; and locator pin 116 passes aperture 44 of jaw 40.

In use, a first rebar 120 is clamped in clamp 16, that is, rebar 120 is positioned against jaw faces 40 and 42 of lower jaw 38. Outer jaw 19 is then swung around, into contact with slot 88 of latch arm 78. Nut 100 is then tightened down to bring jaw 20 into forceable engagement with rebar 120, thus holding rebar 120 parallel to support bar 12 of reinforcing bar holder 10. A splicing sleeve 122 is then fitted onto reinforcing bar 120. A reinforcing bar 124 is lifted, by a crane or other suitable means, and positioned within splicing sleeve 122 in spaced proximity from rebar 120. Reinforcing bar 124 is also rested in the inner jaw 19 of clamp 15. The outer jaw 19 is then swung into contact with reinforcing bar 124, and tightened into place through the action of nut 100. The crane or other device used to support reinforcing bar 124 is then removed; and reinforcing bars 120 and 124 are held in fixed spaced proximity with respect to each other and to splicing sleeve 122. Molten metal is then poured into splicing sleeve 122, and allowed to harden. After the molten metal hardens, clamps 14 and 15 can be released by loosening nuts 100, swinging threaded latch arms 96 away from slot 98, and pivoting outer jaws 19 away from the reinforcing bars 120 and 124 and pivoting them around pivot pin 58. Thus, reinforcing bar aligner and clamp 10 then is ready to be used once again.

Reinforcing bar aligner and clamp 10 has a weight of approximately 73 pounds, and a length from end to end of approximately 5½ feet. Thus, a single operator can manually move reinforcing bar holder 10 from place to place with relative ease. It should be noted that, since clamps 14 and 15 are spaced 57 inches apart and since reinforcing bars have a maximum length of 40 feet, the free ends of rebars 120 and 124 enjoy an optimum mechanical advantage of about 16:1. If the clamps were spaced more closely together, to yield a ratio higher than 20:1, the mechanical advantage of the free ends of the rebars would rapidly increase, causing great difficulty in clamping them. If the length of the center-to-center distance between clamps 14 and 15 was increased, reinforcing bar aligner and clamp 10 would become difficult to handle manually. Also, since support arm 12 would be increased in length, the off-center loading on support arm 12 would increase deformation of support arm 12. This is because the maximum load a given column can carry is in inverse proportion to the square of its length, as given in Euler's formula for columns. Thus, the present dimensions of reinforcing bar aligner and clamp 10 present an optimum of strength and portability.

The ease of shim replacement allows reinforcing bar aligner and clamp 10 to be conveniently used for holding reinforcing bars having different diameters. Shims may be changed by loosening nut 114, lifting pin 116 out of the jaw wall aperture in which it is fitted, and sliding threaded rod 112 out of the slot. A replacement shim then has its threaded rod 112 slipped into the slot; and pin 116 is set into the aperture. Nut 114 is tightened; and the replacement shim is ready for use.

Referring now to FIGS. 9, 10, 11 and 12, a second embodiment of reinforcing bar aligner and clamp 210 is shown therein. Reinforcing bar aligner and clamp 210 includes a support arm 212, to which is attached a pair of clamps, respectively numbered 214 and 215. Each of the clamps 214 and 215 is connected to support arm 212 by a respective pair of mounting plates 216 and 217. Each of the clamps includes an inner V-jaw 218, an outer rotatable cover plate 219 and a latch 220.

Support arm 212 is an elongated rectangular support arm, having a square cross-section. Support arm 212 has a length of 5½ feet, and a width of three inches. Support arm 212 has a plurality of identical rectangular walls, respectively numbered 221, 222, 223 and 224. Support arm 212 is a hollow support arm. Support arm 212 has a pair of opposite ends, respectively numbered 225 and 226.

Clamps 214 and 215 are identical clamps. Clamp 214 is the exemplary clamp. Clamp 214 is connected to support arm 212 by the pair of mounting plates 216, adjacent end 225. Clamp 215 is connected to support arm 212 by the pair of mounting plates 217, adjacent end 226. The pair of mounting plates 216 includes a rectangular hinge plate 230 and a rectangular latch plate 232, respectively connected to walls 222 and 224 of support arm 212. Plates 230 and 232 extend a distance past wall 221, and are positioned parallel to one another. Similarly, the pair of mounting plates 217 includes a rectangular hinge plate 234 and a rectangular latch plate 236. Hinge plate 234 is connected with, and parallel to, wall 222. Latch plate 236 is connected with, and parallel to, wall 224. Plates 234 and 236 extend a distance past wall 221.

Inner V-jaw 218 includes a first inner jaw wall 240 and a second inner jaw wall 242. Jaw walls 240 and 242 are formed integral with, and perpendicular to, each other. Both jaw walls 240 and 242 are positioned at 45° with respect to wall 221 of support arm 212. Jaw wall 240 has a circular aperture 244 and a slot 245 formed therein, at opposite ends. Jaw wall 242 has a circular aperture 246 and a slot 248 formed therein, at opposite ends.

A pair of hollow hinge cylinders, respectively numbered 250 and 251, is connected to opposite ends of an edge 252 of jaw wall 242. Hinge cylinders 250 and 251 are spaced a selected distance apart.

Outer jaw 219 includes a cover plate, or outer jaw plate 254, and is selectively pivotedly connected to hinge cylinders 250 and 251. Cover plate 254 has a hollow hinge cylinder 256, adapted to fit between hinge cylinders 250 and 251. A hinge plate 258 is connected to hinge cylinder 256.

Latch 220 includes a trapezoidal latch plate 260, formed integral with, and at a 20° angle to, hinge plate 258. A slot 262 is formed in a tapered portion 264 of latch plate 260. A pair of rectangular ribs, respectively numbered 266 and 268, is connected to latch plate 260, adjacent and parallel to slot 262. A tapered hinge pin 270, having a slightly tapered body 272 and a short angular head 274, is fitted within hinge cylinders 250, 251 and 256.

A pair of rectangular hinge blocks 276 and 278 is connected to mounting plate 232. A stop bar 280 is connected across hinge blocks 276 and 278. A pivot pin 282 is connected between hinge blocks 276 and 278. Pivot pin 282 has pivotedly attached thereto a latch arm 284. Latch arm 284 has a sleeve 286 and a threaded core 288. A nut 290, having a rectangular grip 292 fitted thereto, is threadedly connected to threaded core 288 of latch arm 284. A plurality of elongated shims, respectively numbered 294, 296 and 298, is respectively connected to jaw walls 240 and 242, and latch plate 260. Shims 294, 296 and 298 are identical to shim 104.

Reinforcing bar aligner and clamp 210 is employed in a fashion quite similar to that of reinforcing bar aligner and clamp 10. Inner V-jaw 218 is positioned against a first rebar. Hinge cylinder 256 is positioned in alignment between hinge cylinders 250 and 251 of V-jaw 218. Pin 270 is then inserted into hinge cylinders 250, 256 and 251. Cover plate 254 is swung into contact with the first reinforcing bar. Latch arm 284 is then swung into slot 262 of cover plate 254; and grip 292 is rotated manually to tighten nut 290, thereby drawing cover plate 254 securely against the first reinforcing bar. A similar process is used to secure the second reinforcing bar. All other details of operation are similar to the operation of reinforcing bar aligner and clamp 210. The reinforcing bar may be released by turning grip 292 to loosen nut 290 and pivoting latch arm 284 out of slot 262. Pin 270 may then be removed from hinge cylinders 250, 251 and 256 by tapping it out with a hammer. Cover plate 254 is then freed, and can be lifted away from V-jaw 218, thereby releasing the reinforcing bar aligher and clamp from the reinforcing bar.

The embodiment of reinforcing bar aligner and clamp 210 is particularly useful for use in close quarters. For instance, the density of reinforcing bars is usually higher in nuclear containment vessels than in other structures. As a result, the space within which the reinforcing bar aligner and clamp can operate necessitates use of the second embodiment, with its removable cover plate. Thus, the removable cover plate 254 need not travel through a large arc to clamp or release the reinforcing bars. Space is also saved by the use of stop bar 280, which prevents latch arm 284 from traveling through a large arc.

It may be appreciated, then, that reinforcing bar aligner and holders 10 and 210 may be used in a variety of reinforcing bar applications. Of particular importance to reinforcing bar aligner and holders 10 and 210 is the fact that they may be quickly and easily used. The amount of crane time necessary to position a pair of reinforcing bars is five minutes when reinforcing bar holder 10 or 210 is employed for connecting reinforcing bars together, as opposed to the usual half hour.

Furthermore, reinforcing bar aligner and holders 10 and 210 may be used to hold a variety of diameters of reinforcing bars simply by changing shims in the clamp jaws or by leaving the shims out. It takes approximately 30 to 60 seconds to change a shim in the present invention.

Although a specific embodiment of the instant invention has been set forth and described in detail above, it is readily apparent that those skilled in the art may make various modifications and changes in the present invention without departing from the spirit and scope thereof. The instant invention is limited only by the appended claims.

I claim:

1. A reinforcing bar aligner and clamp for holding reinforcing bars substantially vertical during splicing, comprising: a first clamp adapted for releasable connection to a fixed lower reinforcing bar, said first clamp having a first inner V-jaw, a first outer jaw and a first latch selectively connectable between said first inner V-jaw and said first outer jaw, said first inner V-jaw having a first inner jaw plate and a second inner jaw plate formed integral with and perpendicular to said first inner jaw plate, said first outer jaw being rotatable about a pivot toward and away from said first inner V-jaw, said first inner V-jaw and said first outer jaw each having a first shim pin aperture and a first shim slot, said first latch having a first threaded rod having a first rotatable threaded connector connected thereto which is selectively pivotable into engagement with said first outer jaw to hold said lower reinforcing bar in fixed engagement with said first clamp; a first plurality of elongated rectangular removable shims, each elongated rectangular removable shim of said first plurality having a shim pin fitted into one of said first shim pin apertures and a threaded shim connector fitted to one of said first shim slots; a first pair of rectangular mounting plates rigidly connected to said first clamp; a square cross-section elongated support art rigidly connected to said first pair of rectangular mounting plates at a first end; a second pair of rectangular mounting plates rigidly connected to said square cross-section elongated support arm adjacent a second end of said square cross-section elongated support arm; and a second clamp rigidly connected to said second pair of mounting plates, said second clamp having a second inner V-jaw, a second outer jaw and a second latch selectively connectable between said second inner V-jaw and said second outer jaw, said second inner V-jaw having a first inner jaw plate and a second inner jaw plate formed integral with said perpendicular to said first inner jaw plate, said second outer jaw being rotatable about a second pivot toward and away from said second inner V-jaw, said second inner V-jaw and said second outer jaw each having a second shim pin aperture and a second shim slot, said second latch having a second threaded rod having a second rotatable threaded connector connected thereto which is selectively pivotable into engagement with said second outer jaw to hold an upper reinforcing bar substantially vertical in fixed substantially abutting end-to-end proximity with said lower reinforcing bar, said second clamp being identical to, and collinear with, said first clamp, said second clamp being separated from said first clamp by a center-to-center distance greater than 0.05 of a length of the longer of said upper and lower reinforcing bars; and a second plurality of elongated rectangular removable shims, each elongated rectangular removable shim of said second plurality having a shim pin fitted into one of said second shim pin apertures and a threaded shim connector fitted to one of said second shim slots.

2. A reinforcing bar aligner and clamp for holding reinforcing bars substantially vertical during splicing as defined in claim 1, in which each of said outer jaws is a unitary plate jaw having a latch slot formed therein, each of said outer jaws being connected to its respective inner V-jaw by a removable connector pin, each of said outer jaws being pivotable about its respective removable connector pin and each threaded rod having a stop positioned adjacent thereto, said stop limiting arcuate travel of said threaded rod.

* * * * *

UNITED STATES PATENT OFFICE

CERTIFICATE OF CORRECTION

PATENT NO. 4,074,897

DATED February 21, 1978

INVENTOR(S) Frederick H. Behn

It is certified that error appears in the above-identified patent and that said Letters Patent are hereby corrected as shown below:

Column 2, Line 29, "broke" should be --broken--.

Column 3, Lines 5 and 6, "Mounting plate 32 is also included in the pair of mounting plates 16." should be deleted.

Column 3, Line 48, "an" should be --and--.

Column 3, Line 58, "tonque" should be --tongue--.

Column 7, Line 15, "art" should be --arm--.

Column 7, Line 27, "said" should be --and--.

Signed and Sealed this

*Twenty-third* Day of *May 1978*

[SEAL]

*Attest:*

RUTH C. MASON
*Attesting Officer*

LUTRELLE F. PARKER
*Acting Commissioner of Patents and Trademarks*